United States Patent [19]

Masumoto et al.

[11] Patent Number: 4,710,243

[45] Date of Patent: Dec. 1, 1987

[54] WEAR-RESISTANT ALLOY OF HIGH PERMEABILITY AND METHOD OF PRODUCING THE SAME

[75] Inventors: Hakaru Masumoto, Sendai; Yuetsu Murakami, Izumi, both of Japan

[73] Assignee: The Foundation: The Research Institute of Electric and Magnetic Alloys, Japan

[21] Appl. No.: 760,038

[22] Filed: Jul. 29, 1985

[30] Foreign Application Priority Data

Jan. 30, 1985 [JP] Japan ..... 60-14556

[51] Int. Cl.[4] ..... H01F 1/04

[52] U.S. Cl. ..... 148/312; 148/426; 148/427; 420/441; 420/442; 420/452; 420/455; 420/456; 420/458; 420/459; 420/460

[58] Field of Search ..... 148/31.55, 426, 427, 148/312; 420/441, 442, 455, 456, 458, 459, 460, 452

[56] References Cited

U.S. PATENT DOCUMENTS

| | | | |
|---|---|---|---|
| 3,743,550 | 7/1973 | Masumoto et al. | 148/31.55 |
| 3,785,880 | 1/1974 | Masumoto et al. | 148/31.55 |
| 3,794,530 | 2/1974 | Masumoto et al. | 148/31.55 |
| 3,837,933 | 9/1974 | Masumoto et al. | 148/31.55 |
| 3,989,555 | 11/1976 | Yamagishi | 148/31.55 |
| 4,440,720 | 4/1984 | Masumoto et al. | 420/459 |
| 4,572,750 | 2/1986 | Masumoto et al. | 148/31.55 |

FOREIGN PATENT DOCUMENTS

| | | | |
|---|---|---|---|
| 3306327 | 9/1983 | Fed. Rep. of Germany | 420/452 |
| 57-123947 | 8/1982 | Japan | 148/31.55 |
| 59-85851 | 5/1984 | Japan | 148/31.55 |
| 59-107052 | 6/1984 | Japan | 420/452 |

*Primary Examiner*—John P. Sheehan

*Attorney, Agent, or Firm*—Parkhurst & Oliff

[57] ABSTRACT

A wear-resistant alloy of high permeability having an effective permeability of at least about 3,000 at 1 KHz, a saturation magnetic flux density of at least about 4,000 G, and a recrystallization texture of {110}<112>+{311}<112> is provided. The alloy is produced by cold working a forged or hot worked ingot of an alloy of a desired composition at a cold working ratio of at least about 50%, heating the cold worked alloy at a temperature which is below the m.p. of the alloy and not less than about 900° C., and cooling the heated alloy from a temperature which is not less than an order-disorder transformation point (about 600° C.) of the alloy. Alternatively, the alloy is produced by reheating the cooled alloy to a temperature which is not over than the order-disorder transformation point, and cooling the reheated alloy.

3 Claims, 12 Drawing Figures

WEAR-RESISTANT ALLOY OF HIGH PERMEABILITY AND METHOD OF PRODUCING THE SAME

BACKGROUND OF THE INVENTION

1. Field of the Invention

The present invention relates to a wear-resistant alloy of high permeability consisting essentially of Ni, Nb and Fe, a wear-resistant alloy of high permeability comprising Ni, Nb and Fe as main components and at least one subsidiary component selected from the group consisting of Cr, Mo, Ge, Au, Co, V, W, Ta, Cu, Mn, Al, Si, Ti, Zr, Hf, Sn, Sb, Ga, In, Tl, Zn, Cd, rare earth elements, platinum group metals, Be, Ag, Sr, Ba, B, P and S, and methods of producing the same.

2. Description of the Prior Art

Heretofore, magnetic record play-back heads of tape-recorders and the like are operated in A.C. magnetic field, so that magnetic alloys used therefor are required to have high effective permeability in a high frequency magnetic field and a good wear-resistant property because they contact with sliding magnetic tapes. Recently, as wear-resistant magnetic alloys for magnetic heads there have been Sendust, which is an Fe-Si-Al series alloy and Mn-Zn ferrite which is an MnO-ZnO-$Fe_2O_3$ alloy. However, these alloys have drawbacks in that they are so hard and brittle that they can not be forged or rolled and have to be processed to head cores by laborsome and time-consuming cutting or grinding work, so that the products are very expensive. Though Sendust has a high magnetic flux density, it can not be processed to a thin plate, so that it has a shortcoming of a relatively low effective permeability value in high frequency magnetic field. While ferrite has a high effective permeability, it has a shortcoming of a low saturation magnetic flux density of about 4,000 G. On the other hand, Permalloy, which is an Ni-Fe series alloy, has a high saturation magnetic flux density, however, it has a drawback of a low effective permeability. Though Permalloy can be mass produced easily by forging, rolling or punching, it has also a great drawback of low wear-resistance.

The inventors had previously found out that an Ni-Fe-Nb series alloy and an Ni-Fe-Ta series alloy are easy to be worked or processed by forging and have high hardness and permeability so that they are suited well to magnetic alloys for magnetic heads, and filed patent applications therefor which matured to U.S. Pat. Nos. 3,743,550 and 3,785,880.

Afterwards, the inventors have produced thin plates of the Ni-Fe-Nb series and Ni-Fe-Ta series alloys for magnetic alloys for magnetic heads. As a result, the inventors have found out a great problem that abrasion or wear-resistant property of a magnetic head made of the thin plate caused by sliding contact of a magnetic tape thereon varies noticeably depending on the manner of working and heat treatment in the process of producing the thin plate, and that the wear-resistant property of the thin plate often shows a considerably inferior value depending on the manner of working and heat treatment.

SUMMARY OF THE INVENTION

Therefore, an object of the present invention is to obviate or mitigate the aforementioned drawbacks, shortcomings and problems of the prior art.

Another object of the present invention is to provide a wear-resistant alloy of high permeability distinguished over prior alloys.

These objects are achieved by the present invention.

In order to scrutinize the cause of the above-described problem of the Ni-Fe-Nb series and Ni-Fe-Ta series alloys, the inventors have made a series of systematic studies and research about the wear or abrasion of these alloys. As a result, it was found out that the wear of these alloys is not primarily determined by their hardness and is closely related to a recrystallization texture which depends on the manners of producing the thin plate of these alloys.

Though it is generally known that an abrasion phenomenon of an alloy varies largely depending on orientation of crystals of the alloy and that crystal anisotropic properties exist in the alloy, the inventors have found out that in the Ni-Fe-Nb series and Ni-Fe-Ta series alloys the alloys are liable to wear at crystal orientation of {100}<001>, and that crystal orientations of {110}<112> and {311}<112>, which results from some rotation about the orientation <112>, afford a splendid wear-resistant property. Namely, the inventors have found out that the Ni-Fe-Nb series and Ni-Fe-Ta series alloys can be appreciably improved in wear-resistant property by forming recrystallization texture of {110}<112>+{311}<112>.

The inventors have made many research based on this finding to form a recrystallization texture of {110}<112>+{311}<112> of the Ni-Fe-Nb series and Ni-Fe-Ta series alloys.

Though it has been known that Ni-Fe series binary alloys form therein after cold rolling thereof a worked aggregated texture of {110}<112>+{112}<111> and a heat treatment of the texture at a high temperature develops a recrystallization texture of {100}<001>, the inventors have found out that a recrystallization texture of {110}<112<+{311}<112> can be effectively formed with remarkably improved wear-resistant property by adding Nb and/or Ta into the Ni-Fe series binary alloys thereby decreasing stacking fault energy, cold working the added alloy at a working ratio of at least about 50%, and heating the cold worked alloy at a high temperature of at least about 900° C.

By the addition of Nb and/or Ta into the Ni-Fe series alloy, specific electric resistance of the alloy is improved and crystal grains of the alloy become minute, so that eddy current loss in an AC magnetic field is decreased to increase the effective permeability of the alloy.

To sum up, by the effect of addition of Nb and/or Ta to the Fe-Ni series alloys, a recrystallization texture of {110}<112>+{311}<112> of the alloys is developed well and the effective permeability of the alloys is exceedingly increased, so that an excellent wear-resistant alloy of high permeability can be obtained.

In order to produce the alloy according to the present invention, an appropriate amount of a mixture or an alloy comprising about 60–90% by weight of Ni, about 0.5–14% by weight of Nb and the remainder of Fe is melted in an appropriate melting furnace in vacuo, in air or preferably in a non-oxidizing atmosphere such as hydrogen, argon, nitrogen or the like. Alternatively, to the above melt is added at least one subsidiary component selected from the group consisting of each not over than about 7% by weight of Cr, Mo, Ge and Au, each not over than about 10% by weight of Co and V, not over than about 15% by weight of W, not over than about 20% by weight of Ta, each not over than about 25% by weight of Cu and Mn, each not over than about 5% by weight of Al, Si, Ti, Zr, Hf, Sn, Sb, Ga, In, Tl (thallium), Zn, Cd, rare earth elements and platinum group elements, each not over than about 3% by weight of Ag, Sr and Ba, each not over than about 1% by weight of B and P, and not over than about 0.1% of S. The sum of the subsidiary components is about 0.01–30% by weight of the total melt. If necessary, an appropriate amount of C, Mg and/or Ca (each 0.3% by weight or less) is added to the melt to enhance forgeability and workability of the cooled melt or ingot. The obtained melt of mixture is thoroughly agitated to obtain a melt alloy of a uniform composition.

The melt alloy is then poured into a mould of an appropriate shape and size to obtain an ingot. The ingot is hot rolled or forged at a high temperature to a suitable shape such as a rod or plate, and, if necessary, annealed. The ingot of suitable shape is then cold worked at a working ratio of at least about 50% by means of e.g. cold rolling to a desired shape such as a thin plate of a thickness of 0.1 mm. From the thin plate an annular plate of an outer diameter of 45 mm and an inner diameter of 33 mm is punched out. The alloy of a shape of an annular plate is heated in vacuo, air or a non-oxidizing atmosphere such as hydrogen, argon, nitrogen or the like at a temperature of at least about 900° C. and below the m.p. of the annular plate for an appropriate time, and then cooled from a temperature which is equal to or higher than an order-disorder transformation point (about 600° C.) of the alloy to a room temperature at an appropriate cooling rate of about 100° C./sec-1° C./hr depending on the composition of the plate. Alternatively, the cooled alloy is reheated to a temperature which is equal to or lower than the transformation point of the alloy for an appropriate time of about 1 min-100 hrs depending on the alloy composition, and then cooled to room temperature.

In this way, an exceedingly wear-resistant alloy of high permeability of a recrystallization texture of {110}<112>+{311}<112> and have an effective permeability of at least about 3,000 at 1 KHz and a saturation magnetic flux density of not less than about 4,000 G is obtained.

BRIEF DESCRIPTION OF THE DRAWINGS

For a better understanding of the present invention, reference is made to the accompanying drawings, in which.

DETAILED EXPLANATION OF THE INVENTION

Figure 1:
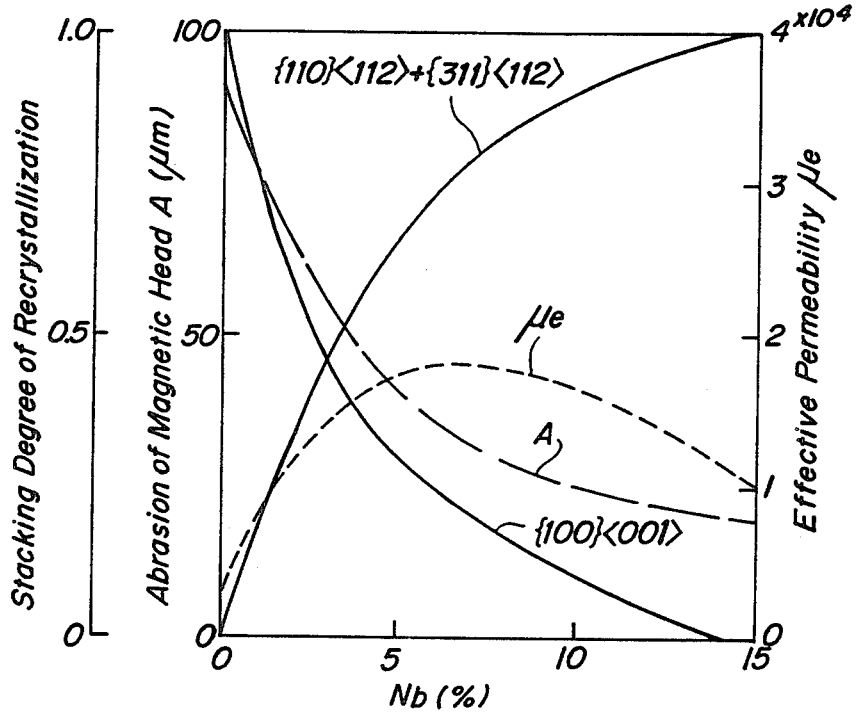
FIG. 1 is a characteristic graph of 79.5%Ni-Fe-Nb series alloys showing relations between the Nb amount and the characteristic properties of the alloys.

Referring in more detail to FIG. 1, the characteristic curves represent relations between the amount of Nb and the characteristic properties such as effective permeability $\mu e$, amount of abrasion of a magnetic head A expressed in $\mu m$ and stacking degree of the recrystallization texture in arbitrary scale of 79.5% (by weight) Ni-Fe-Nb series alloys obtained by cold rolling at a working ratio of 98%, heating at 1,150° C., and cooling at a rate of 1,000° C./hr.

Ni-Fe-Nb series alloys produce therein worked aggregated texture of {110}<112>+{112}<111> if worked by cold rolling. If the cold worked alloy is heated to a high temperature, a recrystallization textures of {100}<001> and {110}<112>+{311}<112> is formed. Now, if Nb is added to the Ni-Fe series alloys to form Ni-Fe-Nb series alloys, the recrystallization texture of {100}<001> is prevented from forming in the cold worked and heat treated alloys, while the recrystallization texture of 55110}<112<+{311}<112> is developed in the alloys accompanied by the decrease of the abrasion of the alloy. Effective permeability of the alloy is increased by the addition of Nb. If the amount of Nb is less than about 0.5% by weight, the effect of addition of Nb is small, while if the amount of Nb is over than 14% by weight, forgeability and workability of the alloy become worse, so that an Nb amount in a range of about 0.5–14% by weight is preferable.

Figure 2:
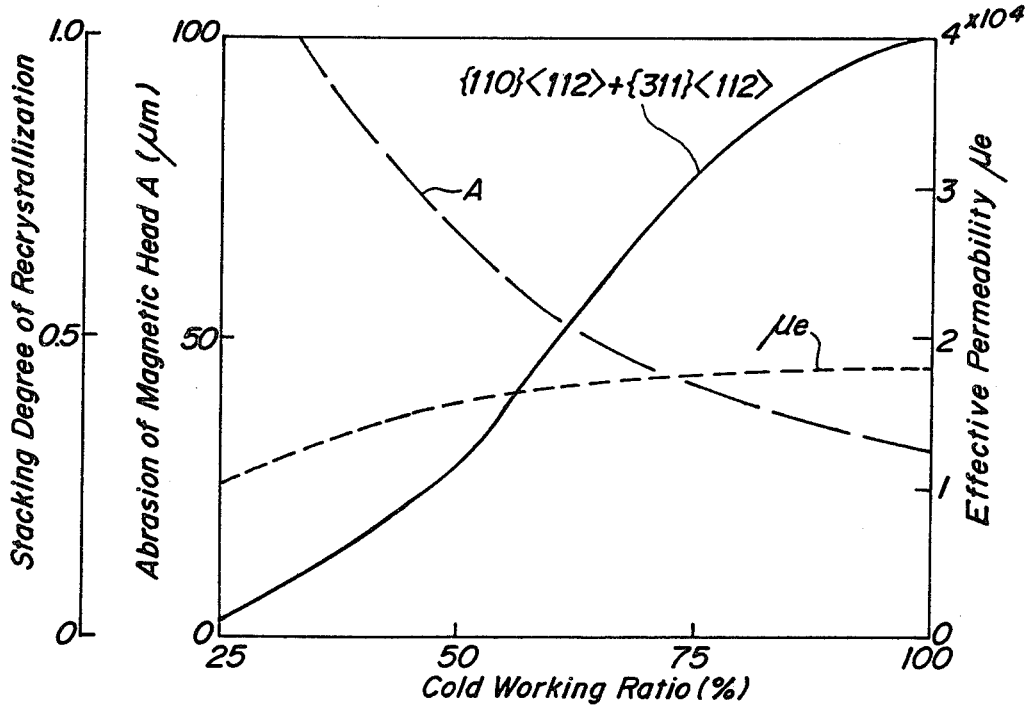
FIG. 2 is a characteristic graph of 79.5%Ni-Fe-7%Nb series alloy showing relations between the cold working ratio and the characteristic properties including the recrystallization texture of the alloy.

Referring in more detail to FIG. 2, the characteristic curves represent relations between the cold working ratio in % and the effective permeability μe, the abrasion amount A of the magnetic head in μm or the stacking degree of the recrystallization texture in arbitrary scale of 79.5% by weight Ni-Fe-7% by weight Nb alloy obtained by heating at a temperature of 1,150° C. and cooling. Increase of the cold working ratio of the alloy causes to develop the recrystallization texture of {110}<112>+{311}<112> in the alloy and raise or improve the effective permeability of the alloy. This phenomenon is particularly noticeable when the cold working ratio is at least about 50%.

Figure 3:
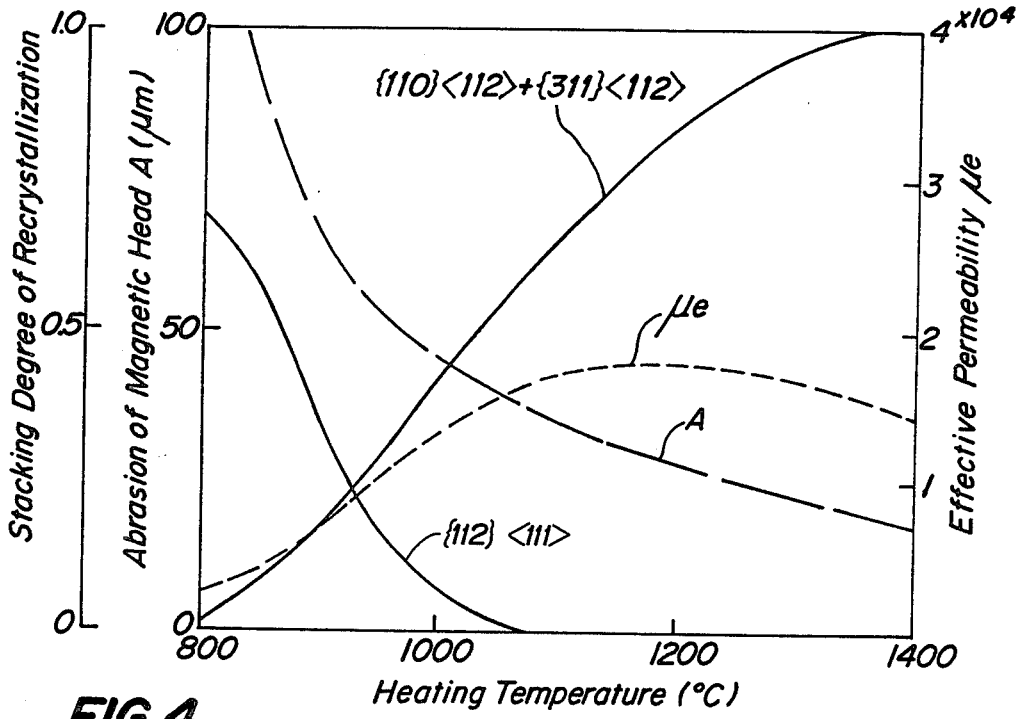
FIG. 3 is a characteristic graph of 79.5%Ni-Fe-7%Nb series alloy showing relations between the heating temperature and the characteristic properties including the recrystallization texture of the alloy.

Referring in more detail to FIG. 3, the characteristic curves represent relations between the heating temperature and the effective permeability μe, the abrasion amount A of the magnetic head in μm or the stacking degree of recrystallization texture in arbitrary scale of 79.5% by weight Ni-Fe-7% by weight Nb alloy obtained by cold rolling ratio of 98% and heating. With the increase of the heating temperature the {112}<111> component is decreased and the {110}<112>+{311}<112> component is developed to improve the wear-resistant property of the alloy as well as the effective permeability. This phenomenon is particularly noticeable at a heating temperature of about 900° C. or more.

Figure 4:
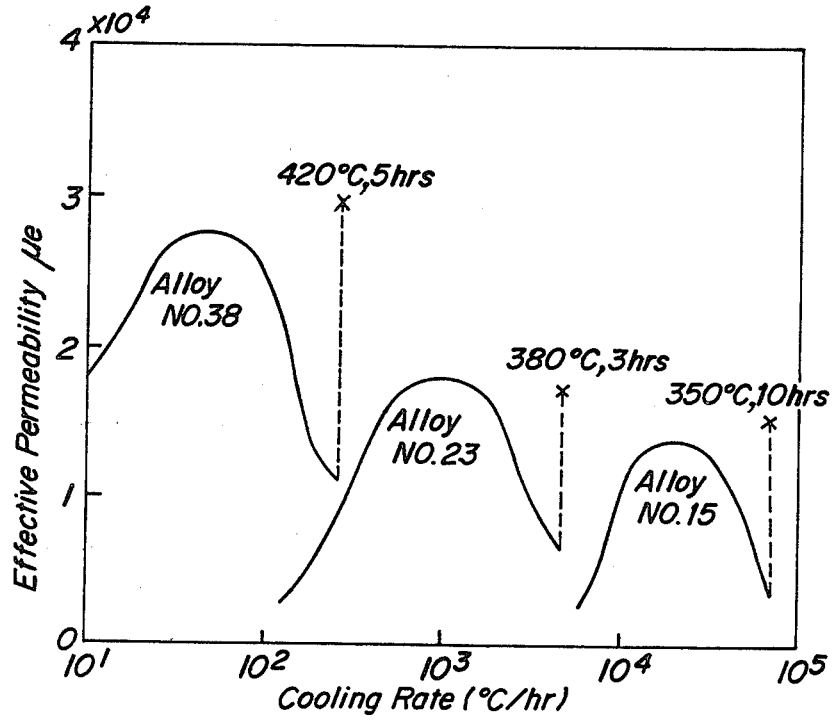
FIG. 4 is a characteristic graph of 79%Ni-Fe-3.5%Nb series alloy (alloy No. 15), 79.5%Ni-Fe-7%Nb series alloy (alloy No. 23) and 82.5%Ni-Fe-5%Nb series alloy (alloy No. 38) showing relations between the cooling rate and the effective permeability with the perameters of reheating time and temperature of the alloys.

Referring in more detail to FIG. 4, the characteristic curves show relations between the cooling rate and the effective permeability μe of 79% by weight Ni-Fe-3.5% by weight Nb alloy (alloy No. 15), 79.5% by weight Ni-Fe-7% by weight Nb alloy (alloy No. 23) and 82.5% by weight Ni-Fe-5% by weight Nb-3% by weight Cr alloy (alloy No. 38) obtained by cold working, heating and cooling. In the drawing effective permeability values with symbol "x" represent values of those alloys obtained by reheating and cooling. It can be understood from the drawing that an optimum cooling rate, an optimum reheating temperature and an optimum reheating time exist depending on composition of the alloys.

Figure 5:
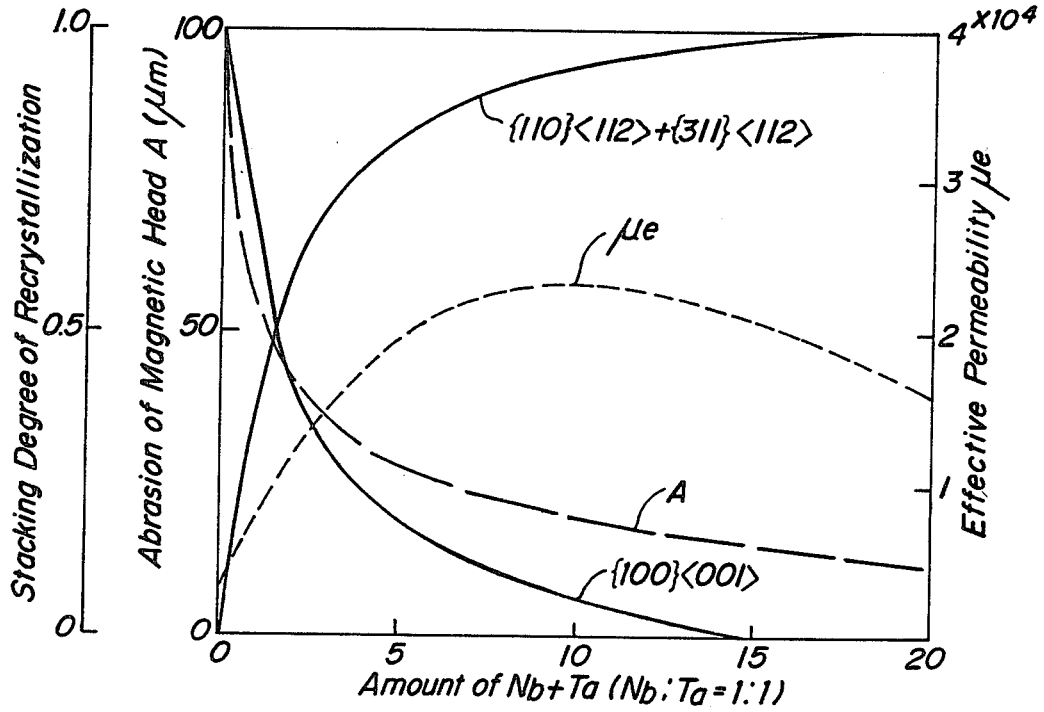
FIG. 5 is a characteristic graph of 79%Ni-Fe-Nb-Ta series alloys showing relations between the amount of Nb+Ta and the characteristic properties including the recrystallization texture of the alloys.

Referring in more detail to FIG. 5, the characteristic curves show relations between a sum of equal weight amounts of Nb and Ta and the effective permeability μe, the abrasion amount A of a magnetic head in μm and the stacking degree of the recrystallization texture in arbitrary scale of 79% by weight Ni-Fe-Nb-Ta series alloys (wherein weight ratio of Nb:Ta=1:1) obtained by cold rolling of a working ratio of 90%, heating at 1,100° C. and cooling at a cooling rate of 800° C./hr. Through Ni-Fe-Nb-Ta series alloys produce therein worked aggregated texture of {110}<112>+{112}<111> when worked by cold rolling and produce therein the recrystallization textures of {100}<001> and {110}<112>+{311}<112> when worked at a high temperature, the recrystallization texture of {100}<001> is prevented from forming and the recrystallization texture of {110}<112+{311}<112> is developed accompanied by the decrease of the abrasion amount, if Nb and Ta are added to produce the alloy. The effective permeability of the alloy is increased by the addition of Nb and Ta. If the sum of Nb and Ta is less than about 0.5% by weight, the effect of addition of Nb+Ta is small, while if the sum of Nb+Ta is over than about 20% by weight, the forgeability and the workability of the alloy becomes worse, so that the sum of Nb+Ta in a range of about 0.5–20% by weight is preferable.

Figure 6:
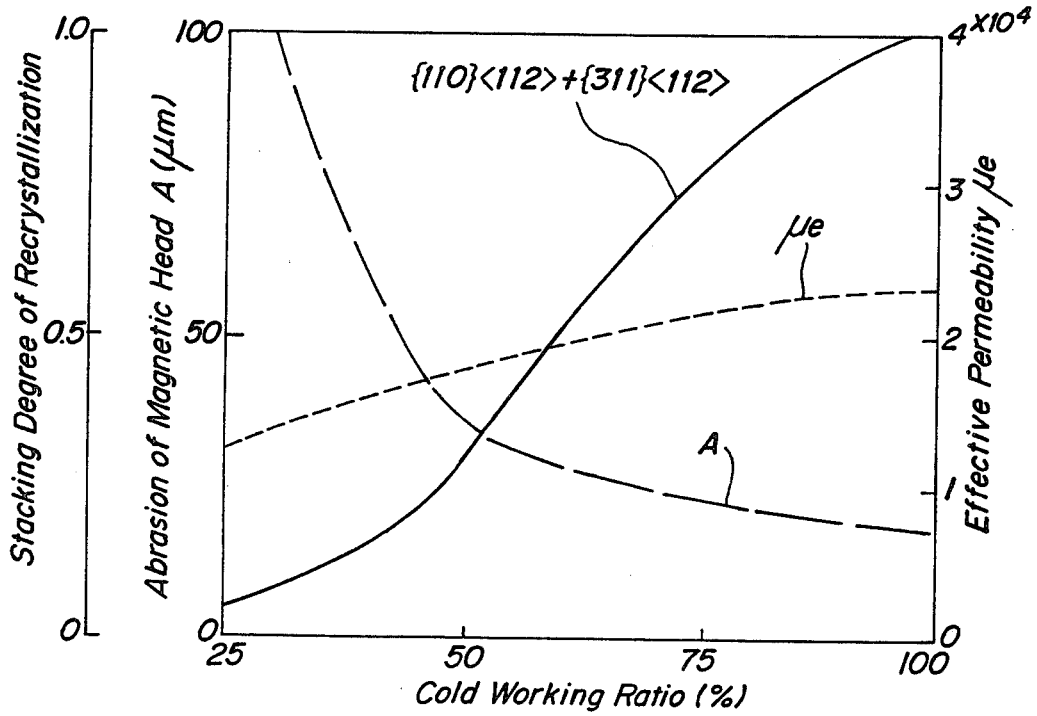
FIG. 6 is a characteristic graph of 79%Ni-Fe-5%Nb-5%Ta series alloy showing relations between the cold working ratio and the characteristic properties including the recrystallization texture of the alloy.

Referring in more detail to FIG. 6, the characteristic curves show relations between the cold working ratio in % and the effective permeability μe, the abrasion amount A of a magnetic head in μm and the stacking degree of the recrystallization texture in arbitrary scale of 79% by weight Ni-Fe-5% by weight Nb-5% by weight Ta alloys obtained by cold working and heating at 1,100° C. Increase of the cold working ratio brings development of the recrystallization structure of {110}<112>+{311}<112>, improves the wear-resistant property of the alloy and promote the effective permeability. This phenomenon is particularly noticeable at a working ratio of at least about 50%.

Figure 7:
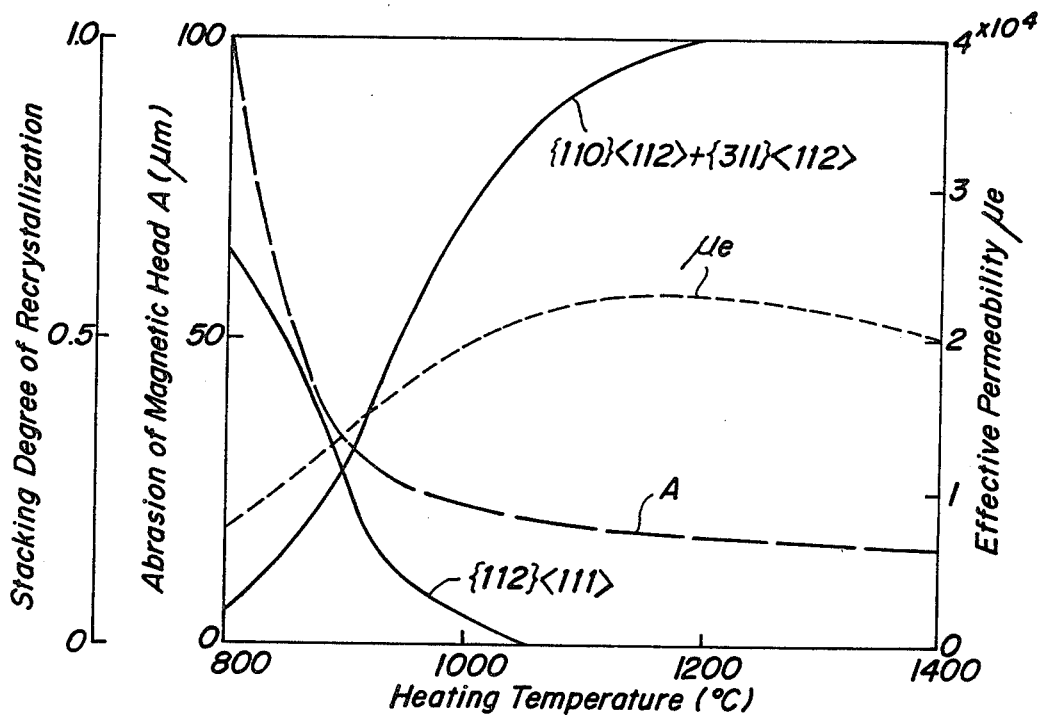
FIG. 7 is a characteristic graph of 79%Ni-Fe-5%Nb-5%Ta series alloy showing a relation between the heating temperature and the characteristic properties including the recrystallization texture of the alloy.

Referring in more detail to FIG. 7, the characteristic curves show relations between the heating temperature and the effective permeability μe, the abrasion amount A of a magnetic head in μm and the stacking degree of the recrystallization texture in arbitrary scale of 79% by weight Ni-Fe-5% by weight Nb-5% by weight Ta alloys obtained by cold rolling of a cold working ratio of 85% and heating at various temperatures. With the increase of the heating temperature, the {112}<111> component is decreased while the texture of {110}<112>+{311}<112> is developed to increase the wear-resistant property as well as the effective permeability. This phenomenon is particularly noticeable at a temperature of about 900° C. or more.

Figure 8:
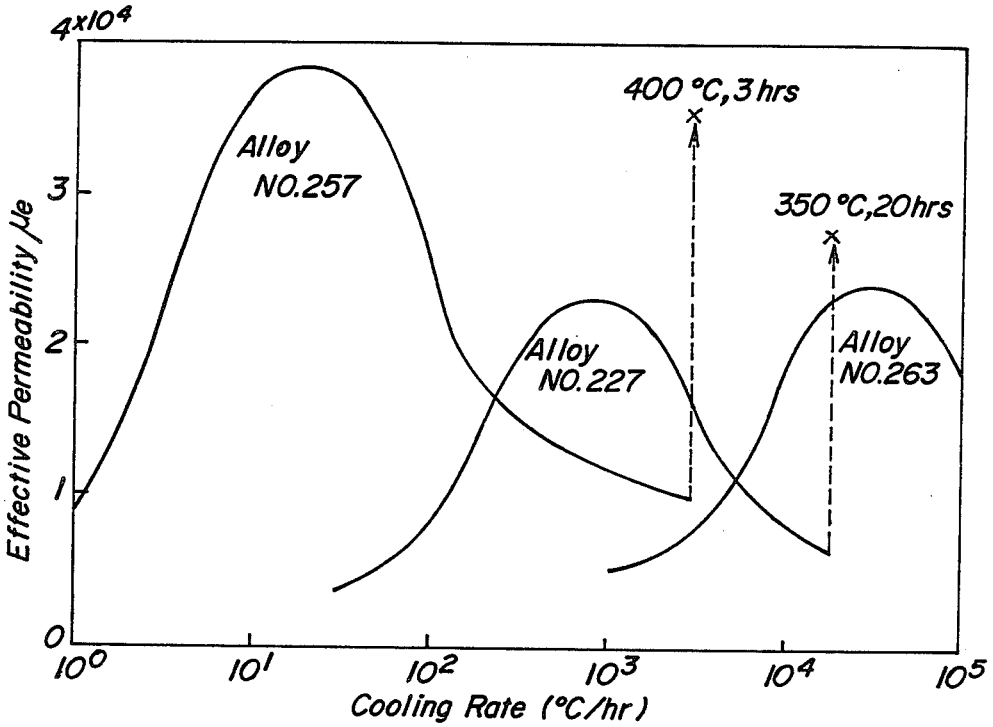
FIG. 8 is a characteristic graph of 80.3%Ni-Fe-2%Nb-2%Ta-3%Ge series alloy (alloy No. 263), 79.5%Ni-Fe-5%Nb-3%Ta-2%MO series alloy (alloy No. 257) and 79%Ni-Fe-5%Nb-5%Ta series alloy (alloy No. 227) showing relations between the cooling rate and the effective permeability with parameters of reheating temperature and time of the alloys.

Referring in more detail to FIG. 8, the characteristic curves show relations between the effective permeability and the cooling rate of 80.3% by weight Ni-Fe-2% by weight Nb-2% by weight Ta-3% by weight Ge alloy (alloy No. 263), 79.5% by weight Ni-Fe-5% by weight Nb-3% by weight Ta-2% by weight Mo alloy (alloy No. 257) and 79% by weight Ni-Fe-5% by weight Nb-5% by weight Ta alloy (alloy No. 227) obtained by cold working and heating at respective temperature and time. In the drawing, the symbol "x" represents values of the effective permeability of the alloys which were subjected to respective reheating temperature and time as shown in the drawing. It can be seen that there are existent an optimum cooling rate, an optimum reheating temperature and an optimum reheating time.

Figure 9:
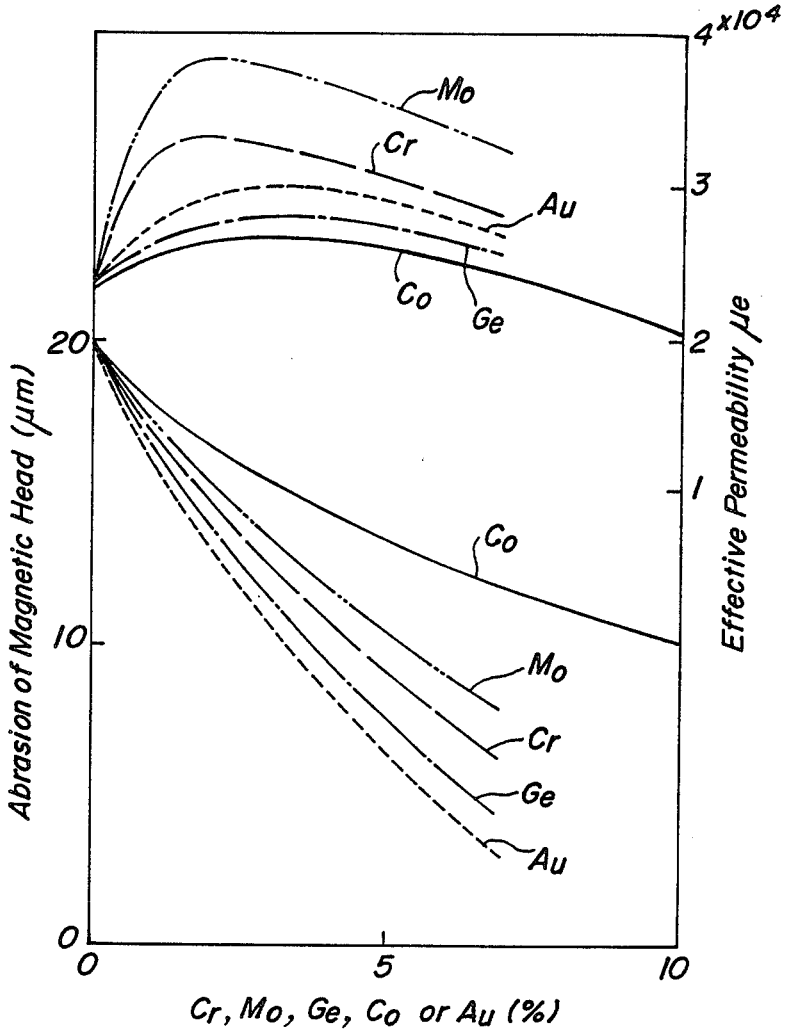
FIG. 9 is a characteristic graph of 79%Ni-Fe-5%Nb-5%Ta series alloy added with Cr, Mo, Ge, Au or Co showing relations between the amount of each element and the characteristic properties of the alloy.

Referring in more detail to FIG. 9, the characteristic curves show relations between the addition amount of a subsidiary component Cr, Mo, Ge, Au or Co and the abrasion amount A of a magnetic head in μm or the effective permeability μe of 79% by weight Ni-Fe-5% by weight Nb-5% by weight Ta alloy added with the subsidiary component. By the addition of the subsidiary component, the effective permeability of all alloys are increased and the abrasion amount is decreased. However, if the amount of Cr, Mo, Ge or Au is more than about 7% by weight, the saturation magnetic flux density becomes less than about 4,000 G, so that the addition of the component of more than about 7% by weight is not preferable. Also, addition of Co of more than about 10% is not preferable, because magnetic remanence is increased to increase noise due to magnetization of the magnetic head.

Figure 10:
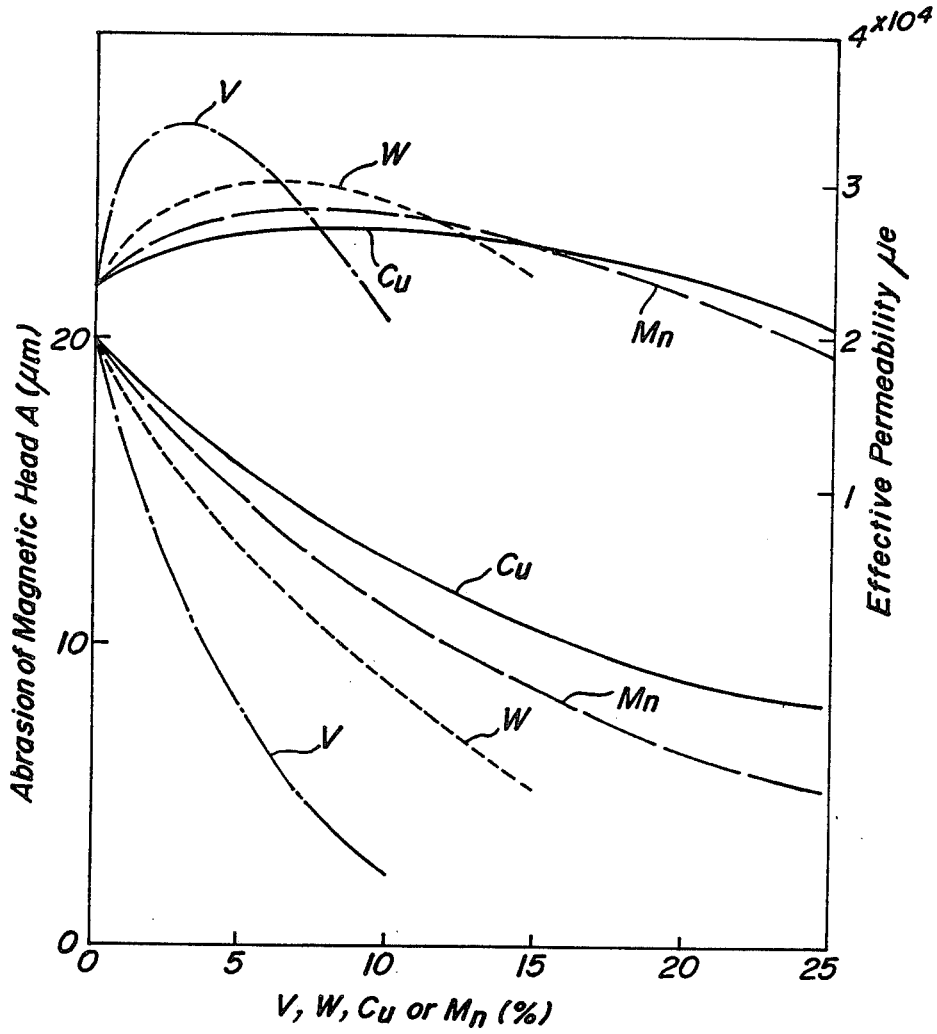
FIG. 10 is a characteristic graph of 79%Ni-Fe-5%Nb-5%Ta series alloy added with V, W, Cu or Mn showing relations between the amount of each element and the characteristic properties of the alloy.

Referring in more detail to FIG. 10, the characteristic curves show relations between the amount of a subsidiary component V, W, Cu or Mn and the effective permeability μe or the abrasion amount A of a magnetic head in μm of 79% by weight Ni-Fe-5% by weight Nb-5% by weight Ta alloy added with the subsidiary component. By the addition of V, W, Cu or Mn, the effective permeability of alloys is increased, while the abrasion amount of the alloys is decreased. However, addition of V of more than about 10% by weight, addition of W of more than about 15% by weight and addition of Cu or Mn of more than about 25% by weight is not preferable, because the saturation magnetic flux density becomes less than about 4,000 G.

Figure 11:
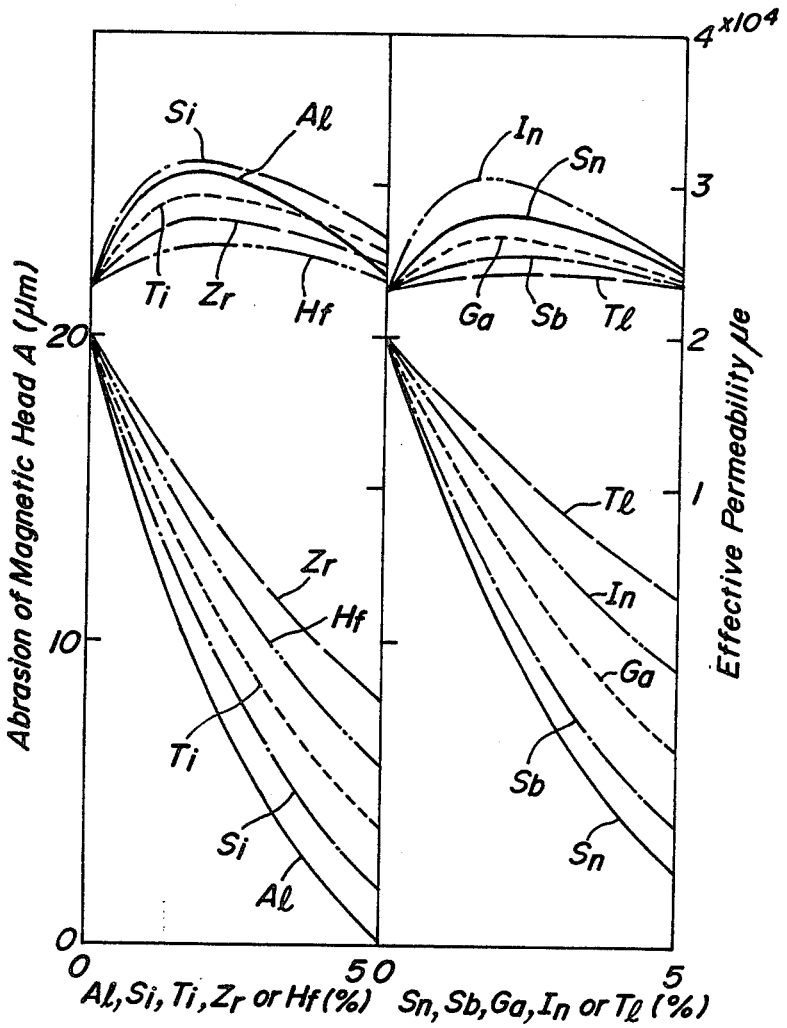
FIG. 11 is a characteristic graph of 79%Ni-Fe-5%Nb-5%Ta series alloy added with Al, Si, Ti, Zr, Hf, Sn, Sb, Ga, In or Tl showing relations between the amount of each element and the characteristic properties of the alloy.

Referring in more detail to FIG. 11, the characteristic curves show relations between the amount of a subsidiary component Al, Si, Ti, Zr, Hf, Sn, Sb, Ga, In or Tl and the effective permeability $\mu e$ or the abrasion amount A of a magnetic head in $\mu m$. By the addition of Al, Si, Ti, Zr, Hf, Sn, Sb, Ga, In or Tl, the effective permeability of the alloys is increased, while the abrasion amount is decreased. However, if Si, Ti, Zr, Hf, Ga, In or Tl is added more than about 5% by weight, the saturation magnetic flux density becomes less than about 4,000 G, so that it is not preferable. Addition of Al, Sn or Sb of more than about 5% by weight is not preferable, because the alloy becomes difficult to be forged.

Figure 12:
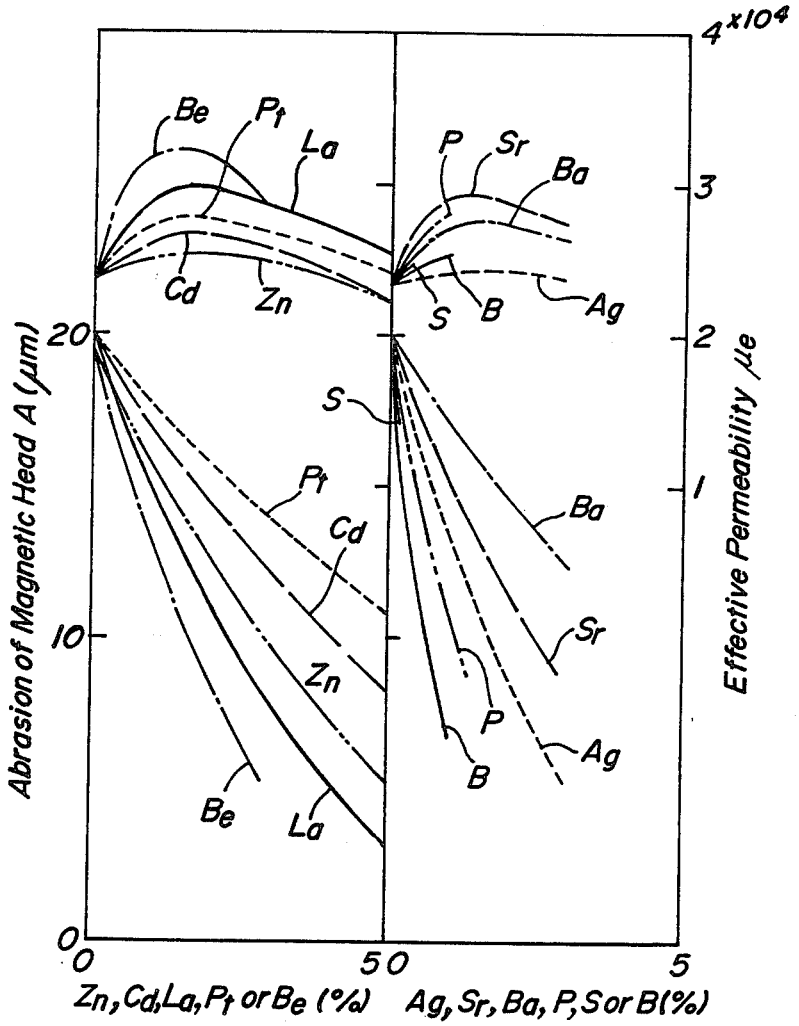
FIG. 12 is a characteristic graph of 79%Ni-Fe-5%Nb-5%Ta series alloy added with Zn, Cd, La, Pt, Be, Ag, Sr, Ba, P, S or B showing relations between the amount of each element and the characteristic properties of the alloy.

Referring in more detail to FIG. 12, the characteristic curves show relations between the amount of a subsidiary component Zn, Cd, La, Pt, Be, Ag, Sr, Ba, P, S or B and the effective permeability $\mu e$ or the abrasion amount A of a magnetic head in $\mu m$ of 79% by weight Ni-Fe-5% by weight Nb-5% by weight Ta alloy added with the subsidiary component. By the addition of the subsidiary component the effective permeability of the alloys is increased, while the abrasion amount of the alloy is decreased. However, addition of Zn, Cd, La or Pt of more than about 5% by weight or addition of Be, Sr or Ba of more than about 3% by weight is not preferable, because the saturation magnetic flux density becomes less than about 4,000 G, and addition of Ag of more than about 3% by weight, P or B of more than about 1% by weight or S of more than about 0.1% by weight is not preferable, because the alloy becomes difficult to be worked by forging.

In the present invention, cold working of the alloy is necessary or essential to form cold worked aggregated texture of $\{110\}<112>+\{112\}<111>$ and to develop the recrystallization texture of $\{110\}<112>+\{311\}<112>$ based on the texture of $\{110\}<112>+\{112\}<111>$. As seen from FIGS. 1, 2, 5 and 6, in case when Nb or the sum of Nb and Ta is more than about 0.5% by weight, particularly after the alloy is cold worked at a cold working ratio of at least about 50%, development of the recrystallization texture of $\{110\}<112>+\{311\}<112>$ is remarkable, the wear-resistant property of the alloy is improved appreciably as well as the effective permeability of the alloy.

In the present invention also, the heating effected subsequent to the cold working is necessary in homogenizing the alloy texture, removing strain caused by the cold working, and developing the recrystallization texture of $\{110\}<112>+\{311\}<112>$ so as to obtain a high effective permeability and a splendid-wear-resistant property. Particularly, as seen from FIGS. 3 and 7, by heating the cold worked alloy to a temperature of at least about 900° C. and preferably below the m.p. of the alloy, the effective permeability and the wear-resistant property of the alloy are noticeably improved.

If the aforementioned cold working and the subsequent heating to a temperature of at least about 900° C. and below the m.p. of the alloy are repeated, the stacking degree of the recrystallization texture of $\{110\}<112>+\{311\}<112>$ is enhanced effectively as well as the wear-resistant property of the alloy. By the repetition of heating and cooling, even if a working ratio of final cold working is less than about 50%, the recrystallization texture of $\{110\}<112>+\{311\}<112>$ can be obtained, so that such case of repetition falls within the scope of the technical concept of the present invention. Therefore, the cold working ratio of the present invention means a total of one or two cold workings throughout the whole production steps, and does not mean solely the cold working ratio in the final cooling step.

Though the cooling of the alloy from a temperature of about 900° C. or more and below the m.p. of the alloy to a temperature of above an order-disorder transformation point (about 600° C.) of the alloy does not have a great influence on the magnetic property of the alloy, regardless whether the cooling is a quenching or annealing, the cooling rate below the transformation point has a great influence on the magnetic property of the alloy as seen in FIGS. 4 and 8. That is, by cooling the alloy from a temperature below the transformation point to a room temperature at an appropriate rate in a range of about 100° C./sec-1° C./hr depending on the composition of the alloy, a degree of ordering in the matrix of the alloy is suitably adjusted to afford an excellent magnetic property of the alloy. If the alloy is cooled rapidly at a cooling rate slightly higher than about 100° C./sec within the above cooling rate range, the degree of ordering in the alloy becomes small. If the alloy is cooled down more rapidly than the above cooling rate, a degree of ordering is not promoted and the regularity of crystals is reduced, thereby deteriorating the magnetic property of the alloy. However, if the alloy of such small degree of ordering is reheated at a temperature of about 200–600° C., which is equal to or below the transformation point of the alloy, for a time of about 1 min–100 hrs depending on the composition of the alloy, then the degree of ordering in the alloy is promoted to a suitable regularity to improve the magnetic property of the alloy. On the other hand, if the alloy is annealed at a slow cooling rate e.g. of smaller than about 1° C./hr from a temperature which is equal to or above the transformation point, then the degree of ordering in the alloy is promoted too much so that the magnetic property of the alloy becomes inferior.

The above heating and/or reheating is preferably effected in an atmosphere containing hydrogen, because it is particularly effective in increasing the effective permeability of the alloy.

A reason of limiting the composition of the alloy of the present invention to about 60–90% by weight of Ni, about 0.5–14% by weight of Nb or about 0.5–20% by weight of Nb+Ta (with the understanding that Nb≦about 14% by weight) and the remainder of Fe, and limiting the subsidiary component to about 0.01–30% by weight of at least one component selected from the group consisting of each about 7% by weight or less of Cr, Mo, Ge and Au, each 10% by weight or less of Co and V, about 15% by weight or less of W, about 20% by weight or less of Ta, each about 25% by weight or less of Cu and Mn, each about 5% by weight or less of Al, Si, Ti, Zr, Hf, Sn, Sb, Ga, In, Tl, Zn, Cd, rare earth elements and platinum group elements, each about 3% by weight or less of Be, Ag, Sr and Ba, each about 1% by weight or less of B and P, and about 0.1% by weight or less of S, is that the alloy outside this composition range has an inferior magnetic property or wear-resistant property, though the alloy within this composition range has an effective permeability of at least about 3,000 at 1 KHz, a saturation magnetic flux density of at least about 4,000 G, the recrystallization texture of $\{110\}<112>+\{311\}<112>$ and an excellent wear-resistant property, as shown in the Examples, the attached drawings, and the Tables 4 and 5 which will later be described.

If Nb or the sum of Nb+Ta is less than about 0.5% by weight, the recrystallization texture of {110}<112>+{311}<112> does not develop sufficiently, so that the alloy is inferior in wear-resistant property. While, if Nb is more than about 14% by weight or the sum of Nb+Ta is more than about 20% by weight, the alloy becomes difficult to forge and the saturation magnetic flux density becomes less than about 4,000 G.

The alloy of the present invention having a composition of about 60–90% by weight of Ni, about 0.5–14% by weight of Nb or about 0.5–20% by weight of the sum of Nb+Ta (with the understanding that Nb is about 14% by weight or less), and the remainder of Fe, has a high effective permeability at least about 3,000 at 1 KHz, a good saturation magnetic flux density of at least about 4,000 G, a splendid wear-resistant property, and an excellent workability. If the alloy is further added to with at least one subsidiary component of Cr, Mo, Ge, Au, W, Ta, V, Cu, Mn, Al, Zr, Si, Ti, Hf, Ga, In, Tl, Zn, Cd, rare earth element, platinum group element, Be, Ag, Sr, Ba, B, P and S etc., the effective permeability of the alloy is generally remarkably increased. If Co is added to the alloy, the saturation magnetic flux density of the alloy is enhanced. If at least one of Au, Mn, Ti, Co, rare earth element, platinum group element, Be, Sr, Ba and B is added to the alloy, the forgeability and the workability of the alloy is improved. If at least one of Al, Sn, Sb, Au, Ag, Ti, Zn, Cd, Be, P, S and V is added to the alloy, the recrystallization texture of {110}<112>+{311}<112> is developed properly to improve the wear-resistant property of the alloy.

The alloy of the present invention is easy to forge and hot work. In addition, it has the recrystallization texture of {110}<112>+{311}<112>, so that it has a splendid wear-resistant property, a superior saturation magnetic flux density of at least about 4,000 G, and a high effective permeability of at least about 3,000 at 1 KHz. Therefore, the alloy is suitable for a magnetic head for magnetic record play-back apparatuses as well as a magnetic material for general electro-magnetic apparatuses and devices which require wear-resistant property and high permeability.

DESCRIPTION OF THE PREFERRED EMBODIMENTS

Hereinafter, the present invention will be explained in more detail with reference to Examples which however should not be construed by any means as limitations of the present invention. In the following Examples, all % of alloy components are shown by weight basis, unless otherwise specified.

EXAMPLE 1

Preparation of an alloy of a composition of Ni=79.5%, Nb=7% and Fe=the remainder (alloy No. 23).

As raw materials, electrolytic nickel having a purity of 99.8%, electrolytic iron having a purity of 99.9% and niobium metal of a purity of 99.8% are used. For preparing a sample, the raw materials in a total weight of 800 g is put into an alumina crucible, melted in vacuo in a high frequency induction electric furnace, agitated well to yield a homogeneous melt of the alloy. The melt is poured into a mould having a cavity of a diameter of 25 mm and a height of 170 mm. The resultant ingot is forged at a temperature of about 1,100° C. to obtain a plate of a thickness of 7 mm. The plate is hot rolled at a temperature of about 900–1,200° C. to obtain an appropriate thickness, and subsequently cold rolled with various working ratios at an ambient temperature to a thin plate of 0.1 mm thickness. Then, annular plates of an outer diameter of 45 mm and an inner diameter of 33 mm are punched out from the thin plate.

Thereafter, the annular plates are treated with various heat treatments to produce cores of a magnetic head. Magnetic properties of the heat treated plate were measured, while abrasion at a humidity of 80% and a temperature of 40° C. by running a $CrO_2$ magnetic tape for 200 hrs thereover are also measured by means of Talisurf surface roughness meter. The results are shown in Table 1.

TABLE I

| Cold working and heat treatment | Effective permeability μe | Saturation magnetic flux density Bs(G) | Coercive force Hc(Oe) | Abrasion amount A(μm) |
|---|---|---|---|---|
| Cold rolled at a working ratio of 25%, heated in hydrogen at 1,150° C. for 2 hrs, and cooled at a rate of 1,000° C./hr | 10,000 | 6,750 | 0.0320 | 135 |
| Cold rolled at a working ratio of 70%, heated in hydrogen at 1,150° C. for 2 hrs, and cooled at a rate of 1,000° C./hr | 16,700 | 6,780 | 0.0195 | 42 |
| Cold rolled at a working ratio of 98%, heated in hydrogen at 700° C. for 3 hrs, and cooled at a rate of 1,000° C./hr | 1,500 | 6,730 | 0.3300 | 130 |
| Cold rolled at a working ratio of 98%, heated in hydrogen at 1,000° C. for 2 hrs, and cooled at a rate of 1,000° C./hr | 13,100 | 6,770 | 0.0210 | 45 |
| Cold rolled at a working ratio of 98%, heated in hydrogen at 1,150° C. for 2 hrs, and cooled at a rate of 1,000° C./hr | 18,000 | 6,800 | 0.0180 | 31 |
| Cold rolled at a working ratio of 98%, heated in hydrogen at 1,250° C. for 1 hr, and cooled at a rate of 1,000° C./hr | 17,500 | 6,790 | 0.0190 | 25 |
| Cold rolled at a working ratio of 99%, heated in hydrogen at 1,150° C. for 1 hr, and cooled at a rate of 1,000° C./hr | 18,300 | 6,800 | 0.0170 | 31 |

EXAMPLE 2

Preparation of an alloy of a composition of Ni=79%, Nb=5%, Ta=5% and Fe=the remainder (alloy No. 227).

As raw materials, nickel, iron and niobium having the same purities as those of Example 1 and tantalum of a purity of 99.8% are used. From the raw materials, samples of annular plates were prepared in a similar manner as in Example 1. The sample annular plates, cold worked by various cold working ratios,were treated with various heat treatments to produce cores of a magnetic head. Magnetic properties of the heat treated plate were measured, while abrasion amounts of the cores at a humidity of 80% and 40° C. by running a $CrO_2$ magnetic tape for 200 hrs thereover were also measured. The results are shown in Table 2.

TABLE 2

| Cold working and heat treatment | Effective permeability μe | Saturation magnetic flux density Bs(G) | Coercive force Hc(Oe) | Abrasion amount A(μm) |
|---|---|---|---|---|
| Cold rolled at a working ratio of 30%, heated in hydrogen at 1,150° C. for 2 hrs, and cooled at a rate of 20° C./hr | 28,000 | 6,030 | 0.0124 | 110 |
| Cold rolled at a working ratio of 70%, heated in hydrogen at 1,150° C. for 2 hrs, and cooled at a rate of 20° C./hr | 30,900 | 6,040 | 0.0081 | 25 |
| Cold rolled at a working ratio of 98%, heated in hydrogen at 800° C. for 3 hrs, and cooled at a rate of 20° C./hr | 24,500 | 6,030 | 0.0142 | 105 |
| Cold rolled at a working ratio of 98%, heated in hydrogen at 1,000° C. for 3 hrs, and cooled at a rate of 20° C./hr | 32,600 | 6,040 | 0.0050 | 15 |
| Cold rolled at a working ratio of 98%, heated in hydrogen at 1,150° C. for 2 hrs, and cooled at a rate of 20° C./hr | 38,400 | 6,050 | 0.0032 | 13 |
| Cold rolled at a working ratio of 98%, heated in hydrogen at 1,250° C. for 1 hr, and cooled at a rate of 20° C./hr | 37,500 | 6,050 | 0.0044 | 12 |
| Cold rolled at a working ratio of 98%, heated in hydrogen at 1,350° C. for 2 hrs, and cooled at a rate of 20° C./hr | 36,200 | 6,040 | 0.0063 | 10 |

EXAMPLE 3

Preparation of an alloy of a composition of Ni=80.1%, Nb=7%, P=0.2%, S=0.05%, Mo=2% and Fe=the remainder (alloy No. 182).

As raw materials, nickel, iron and niobium having the same purities as those of Example 1, molybdenum having a purity of 99.8%, ferrophosphoalloy of a phosphorus content of 25%, and iron sulfide of a sulfur content of 25%, were used. From the raw materials, sample annular plates were prepared in a similar manner as in Example 1. The sample annular plates, cold worked by various cold working ratios were treated with various heat treatments to produce cores of a magnetic head. Magnetic properties of the heat treated plate were measured, while abrasion amounts of the cores at a humidity of 80% and 40° C. by running a $CrO_2$ magnetic tape for 200 hrs thereover were also measured. The results are shown in the following Table 3.

Characteristic properties of typical alloys are shown in the following Tables 4 and 5.

TABLE 3

| Cold working and heat treatment | Effective permeability μe | Saturation magnetic flux density Bs(G) | Coercive force Hc(Oe) | Abrasion amount A(μm) |
|---|---|---|---|---|
| Cold rolled at a working ratio of 30%, heated in hydrogen at 1,100° C. for 2 hrs, and cooled at a rate of 50° C./hr | 21,200 | 5,900 | 0.0152 | 115 |
| Cold rolled at a working ratio of 70%, heated in hydrogen at 1,100° C. for 2 hrs, and cooled at a rate of 50° C./hr | 23,700 | 5,910 | 0.0124 | 23 |
| Cold rolled at a working ratio of 95%, heated in hydrogen at 800° C. for 3 hrs, and cooled at a rate of 50° C./hr | 13,600 | 5,890 | 0.0530 | 125 |
| Cold rolled at a working ratio of 95%, heated in hydrogen at 1,000° C. for 3 hrs, and cooled at a rate of 50° C./hr | 25,100 | 5,910 | 0.0100 | 17 |
| Cold rolled at a working ratio of 95%, heated in hydrogen at 1,100° C. for 2 hrs, and cooled at a rate of 50° C./hr | 26,800 | 5,930 | 0.0095 | 15 |
| Cold rolled at a working ratio of 95%, heated in hydrogen at 1,250° C. for 1 hr, and cooled at a rate of 50° C./hr | 26,500 | 5,930 | 0.0098 | 12 |
| Cold rolled at a working ratio of 95%, heated in hydrogen at 1,350° C. for 2 hrs, and cooled at a rate of 50° C./hr | 25,200 | 5,920 | 0.0110 | 11 |

TABLE 4(a)

| Alloy No. | Composition (%) (the remainder is Fe) Ni | Nb | Subsidiary component | Cold working ratio (%) | Heating temperature (°C.) | Cooling rate (°C./hr) | Reheating Temperature (°C.) | Time (hr) | Effective permeability μe (1 KHz) | Saturation magnetic flux density (G) | Coercive force (Oe) | Abrasion amount A (μm) |
|---|---|---|---|---|---|---|---|---|---|---|---|---|
| 7 | 78.3 | 1.5 | — | 95 | 1,200 | 40,000 | — | — | 10,100 | 9,700 | 0.0341 | 70 |
| 15 | 79.0 | 3.5 | — | 90 | 1,100 | 80,000 | 350 | 10 | 15,000 | 8,400 | 0.0210 | 50 |
| 23 | 79.5 | 7.0 | — | 98 | 1,150 | 1,000 | — | — | 18,000 | 6,800 | 0.0180 | 31 |
| 30 | 80.7 | 11.5 | — | 80 | 1,050 | 4,000 | 400 | 2 | 15,800 | 4,500 | 0.0204 | 24 |
| 38 | 82.5 | 5.0 | Cr 3.0 | 90 | 1,100 | 200 | 420 | 5 | 29,500 | 5,820 | 0.0081 | 18 |
| 46 | 79.0 | 3.0 | Mo 2.0, Sr 0.2 | 95 | 1,050 | 100 | — | — | 22,000 | 7,100 | 0.0113 | 19 |
| 55 | 78.0 | 8.5 | Ta 0.3, La 0.7 | 98 | 1,200 | 50 | — | — | 24,600 | 6,000 | 0.0095 | 17 |
| 63 | 79.5 | 10.0 | Ba 0.2, Co 3.0 | 95 | 1,150 | 400 | 400 | 1 | 25,300 | 5,350 | 0.0090 | 15 |
| 71 | 80.0 | 4.0 | Ge 1.5, Ga 0.5 | 90 | 1,150 | 800 | — | — | 23,700 | 6,840 | 0.0105 | 18 |

TABLE 4(a)-continued

| Alloy No. | Composition (%) (the remainder is Fe) Ni | Nb | Subsidiary component | Cold working ratio (%) | Heating temperature (°C.) | Cooling rate (°C./hr) | Reheating Temperature (°C.) | Time (hr) | Effective permeability μe (1 KHz) | Saturation magnetic flux density (G) | Coercive force (Oe) | Abrasion amount A (μm) |
|---|---|---|---|---|---|---|---|---|---|---|---|---|
| 79 | 76.3 | 5.5 | W 3.0, P 0.1 | 98 | 1,200 | 200 | — | — | 27,200 | 7,200 | 0.0086 | 18 |
| 87 | 81.5 | 3.0 | V 1.5, B 0.1 | 95 | 1,000 | 800 | — | — | 23,100 | 7,530 | 0.0110 | 16 |
| 95 | 69.0 | 4.0 | Cu 11.0, Ba 0.2 | 90 | 1,250 | 1,000 | 350 | 8 | 26,300 | 6,710 | 0.0090 | 19 |

TABLE 4(b)

| Alloy No. | Composition (%) (the remainder is Fe) Ni | Nb | Subsidiary component | Cold working ratio (%) | Heating temperatrue (°C.) | Cooling rate (°C./hr) | Reheating Temperature (°C.) | Time (hr) | Effective permeability μe (1 KHz) | Saturation magnetic flux density (G) | Coercive force (Oe) | Abrasion amount A (μm) |
|---|---|---|---|---|---|---|---|---|---|---|---|---|
| 103 | 79.5 | 7.5 | Al 0.5, Zn 0.5 | 98 | 1,050 | 20 | — | — | 24,800 | 6,240 | 0.0098 | 15 |
| 112 | 78.2 | 5.0 | Si 1.0, Sb 1.0 | 85 | 1,100 | 400 | — | — | 23,000 | 6,680 | 0.0117 | 16 |
| 120 | 79.0 | 6.5 | Ti 1.0, In 1.0 | 95 | 1,050 | 800 | 380 | 5 | 27,900 | 5,860 | 0.0090 | 15 |
| 128 | 80.5 | 7.0 | Zr 1.0, Tl 1.0 | 90 | 1,100 | 200 | — | — | 28,200 | 5,930 | 0.0084 | 17 |
| 135 | 79.7 | 5.3 | Hf 1.5, Sn 0.5 | 98 | 1,100 | 400 | — | — | 24,700 | 6,300 | 0.0096 | 15 |
| 143 | 79.5 | 6.5 | Be 0.5, Mn 5.0 | 98 | 1,050 | 800 | — | — | 23,600 | 6,410 | 0.0114 | 13 |
| 152 | 80.3 | 6.0 | Cd 0.3, Mo 1.0 | 90 | 1,150 | 1,000 | 400 | 3 | 26,400 | 6,590 | 0.0098 | 15 |
| 160 | 79.6 | 5.0 | Au 2.0, Ce 1.0 | 95 | 1,200 | 200 | — | — | 22,800 | 6,140 | 0.0120 | 18 |
| 169 | 79.8 | 2.5 | Ta 0.4, Pt 1.0, Mo 3.0 | 95 | 1,300 | 50 | — | — | 21,700 | 6,700 | 0.0157 | 17 |
| 175 | 75.3 | 6.5 | S 0.03, W 5.0 | 98 | 1,150 | 400 | 380 | 4 | 24,600 | 6,060 | 0.0107 | 15 |
| 182 | 80.1 | 7.0 | P 0.2, S 0.05, Mo 2.0 | 95 | 1,100 | 50 | — | — | 26,800 | 5,930 | 0.0095 | 15 |

TABLE 5(a)

| Alloy No. | Composition (%) (the remainder is Fe) Ni | Nb | Ta | Subsidiary component | Cold working ratio (%) | Heating temperature (°C.) | Cooling rate (°C./hr) | Reheating Temperature (°C.) | Time (hr) | Effective permeability μe (1 KHz) | Saturation magnetic flux density (G) | Coercive force (Oe) | Abrasion amount A (μm) |
|---|---|---|---|---|---|---|---|---|---|---|---|---|---|
| 200 | 69.5 | 0.2 | 17.5 | — | 95 | 1,150 | 1,000 | 350 | 5 | 18,600 | 6,050 | 0.0184 | 17 |
| 208 | 73.8 | 1.2 | 14.0 | — | 98 | 1,100 | 400 | — | — | 20,500 | 6,640 | 0.0150 | 18 |
| 215 | 74.5 | 3.0 | 10.0 | — | 95 | 1,050 | 200 | — | — | 21,800 | 7,860 | 0.0122 | 17 |
| 227 | 79.0 | 5.0 | 5.0 | — | 90 | 1,100 | 200 | — | — | 23,000 | 7,310 | 0.0110 | 20 |
| 235 | 79.5 | 8.0 | 2.0 | — | 85 | 1,050 | 100 | — | — | 22,700 | 6,080 | 0.0115 | 21 |
| 242 | 79.3 | 10.0 | 0.3 | — | 90 | 1,200 | 1,000 | 400 | 1 | 20,700 | 5,020 | 0.0147 | 17 |
| 250 | 75.7 | 2.0 | 12.0 | Cr 2 | 90 | 1,200 | 1,000 | 380 | 5 | 32,500 | 6,360 | 0.0057 | 11 |
| 257 | 79.5 | 5.0 | 3.0 | Mo 2 | 98 | 1,150 | 20 | — | — | 38,400 | 6,050 | 0.0032 | 13 |
| 263 | 80.3 | 2.0 | 2.0 | Ge 3 | 95 | 1,100 | 20,000 | 350 | 20 | 27,700 | 6,210 | 0.0107 | 12 |
| 270 | 80.0 | 4.0 | 5.5 | Au 2, Al 0.5 | 90 | 1,000 | 100 | — | — | 26,900 | 6,150 | 0.0100 | 10 |
| 276 | 68.0 | 10.5 | 7.0 | Co 5, Sn 0.5 | 95 | 1,150 | 800 | 420 | 1 | 27,200 | 7,730 | 0.0140 | 13 |
| 284 | 80.3 | 5.0 | 1.5 | V 3, Tl 1 | 90 | 1,050 | 50 | — | — | 31,000 | 6,840 | 0.0076 | 12 |
| 292 | 67.5 | 3.0 | 12.0 | Cu 10, Hf 1 | 95 | 1,000 | 10,000 | 350 | 5 | 28,300 | 6,360 | 0.0085 | 10 |
| 301 | 80.2 | 7.0 | 5.0 | Mn 3, Cd 1 | 85 | 1,200 | 400 | — | — | 27,600 | 6,520 | 0.0103 | 10 |
| 310 | 78.7 | 3.0 | 10.0 | Si 1.5, In 1 | 98 | 1,150 | 200 | — | — | 29,200 | 5,970 | 0.0075 | 9 |
| 318 | 80.3 | 8.5 | 0.4 | Ti 1, Pt 0.5 | 90 | 1,050 | 100 | — | — | 27,500 | 5,930 | 0.0094 | 12 |

TABLE 5(b)

| Alloy No. | Composition (%) (the remainder is Fe) Ni | Nb | Ta | Subsidiary component | Cold working ratio (%) | Heating temperature (°C.) | Cooling rate (°C./hr) | Reheating Temperature (°C.) | Time (hr) | Effective permeability μe (1 KHz) | Saturation magnetic flux density (G) | Coercive force (Oe) | Abrasion amount A (μm) |
|---|---|---|---|---|---|---|---|---|---|---|---|---|---|
| 325 | 68.5 | 1.0 | 14.0 | W 5, La 0.5 | 80 | 1,250 | 400 | 380 | 2 | 31,700 | 5,580 | 0.0066 | 11 |
| 332 | 79.8 | 5.5 | 3.0 | Zr 1, Cr 1 | 90 | 1,100 | 100 | — | — | 28,400 | 5,960 | 0.0084 | 13 |
| 341 | 79.5 | 2.5 | 8.0 | Zn 1.5, Mo 1 | 95 | 1,150 | 50 | — | — | 30,600 | 6,720 | 0.0075 | 13 |
| 353 | 78.0 | 1.8 | 12.0 | Sb 0.7, V 1.5 | 95 | 1,050 | 200 | — | — | 29,000 | 6,370 | 0.0080 | 11 |
| 360 | 77.0 | 7.0 | 7.0 | Ga 1, Cu 3 | 90 | 950 | 800 | — | — | 28,400 | 5,900 | 0.0091 | 13 |
| 365 | 72.0 | 0.7 | 15.0 | Be 0.5, W 3 | 95 | 1,100 | 1,000 | 400 | 2 | 31,600 | 6,120 | 0.0072 | 11 |
| 373 | 79.5 | 7.0 | 2.0 | Ru 1.5 | 90 | 1,200 | 100 | — | — | 29,500 | 6,580 | 0.0086 | 12 |
| 381 | 76.3 | 2.0 | 13.0 | Ag 0.7, Mn 1 | 90 | 1,050 | 1,000 | 350 | 10 | 27,300 | 7,240 | 0.0110 | 10 |
| 393 | 79.0 | 6.0 | 2.5 | Sr 1, Mo 1 | 85 | 1,100 | 50 | — | — | 31,800 | 6,500 | 0.0073 | 12 |
| 399 | 77.5 | 3.0 | 10.0 | Ba 1, Si 1 | 95 | 1,050 | 1,000 | — | — | 29,000 | 6,270 | 0.0096 | 13 |
| 407 | 78.5 | 6.0 | 7.0 | B 0.3, Ti 1 | 90 | 1,100 | 800 | — | — | 28,600 | 6,180 | 0.0107 | 13 |
| 415 | 77.2 | 4.0 | 5.0 | P 0.3, W 4 | 95 | 1,150 | 1,000 | 400 | 1 | 27,400 | 6,480 | 0.0103 | 10 |
| 423 | 79.5 | 5.5 | 4.5 | S 0.02, Mo 3 | 98 | 1,200 | 200 | — | — | 26,200 | 6,130 | 0.0110 | 12 |
| Perm- | 78.5 | — | — | — | 98 | 1,100 | 10,000 | — | — | 2,800 | 10,800 | 0.0550 | 110 |

TABLE 5(b)-continued

| Alloy No. | Composition (%) (the remainder is Fe) Ni | Nb | Ta | Subsidiary component | Cold working ratio (%) | Heating temperature (°C.) | Cooling rate (°C./hr) | Reheating Temperature (°C.) | Reheating Time (hr) | Effective permeability μe (1 KHz) | Saturation magnetic flux density (G) | Coercive force (Oe) | Abrasion amount A (μm) |
|---|---|---|---|---|---|---|---|---|---|---|---|---|---|
| alloy | | | | | | | | | | | | | |

As clearly apparent from the foregoing detailed explanation, the alloy of the present invention has a splendid wear-resistant property, a good saturation magnetic flux density of at least about 4,000 G, a high effective permeability of at least about 3,000 at 1 KHz and a low coercive force, so that it is suited well for not only a magnetic alloy for a casing or core of a magnetic head of a magnetic record play-back apparatus, but also for a magnetic material for general electromagnetic apparatuses and devices which necessitate a splendid wear-resistant property and a high permeability. In addition, the alloy of the present invention is easy to forge or hot work. Thus, the present invention is eminently useful industrially.

Although the present invention has been explained with reference to specific values and embodiments, it will of course be apparent to those skilled in the art that the present invention is not limited thereto and many variations and modifications are possible without departing from the broad aspect and scope of the present invention as defined in the appended claims.

What is claimed is:

1. A wear-resistant alloy having a high permeability, comprising by weight about 60–90% of Ni, about 0.5–14% of Nb, and a remainder being Fe with unavoidable impurities, and having an effective permeability of at least about 3,000 at 1 KHz, a saturation magnetic flux density of at least about 4,000 G, and a recrystallized texture of {110}<112>+{311}<112>.

2. A wear-resistant alloy having a high permeability, comprising by weight about 60–90% of Ni and about 0.5–14% of Nb as main components; about 0.01–30% of at least one subsidiary component selected from the group consisting of each not over than about 7% of Cr, Mo, Ge and Au, each not over than about 10% of Co and V, not over than about 15% of W, not over than about 20% of Ta, each not over than about 25% of Cu and Mn, each not over than about 5% of Al, Si, Ti, Zr, Hf, Sn, Sb, Ga, In, Tl, Zn, Cd, rare earth elements and platinum group elements, each not over than about 3% of Be, Ag, Sr and Ba, each not over than about 1% of B and P, and not over than about 0.1% of S; and a remainder being Fe as a main component with a minor amount of unavoidable impurities, and having an effective permeability of at least about 3,000 at 1 KHz, a saturation magnetic flux density of at least about 4,000 G, and a recrystallized texture of {110}<112>+{311}<112>.

3. A wear-resistant alloy having a high permeability, comprising by weight about 60–90% of Ni, about 0.5–14% of Nb and about 0.001–0.1% of S as main components; about 0.01–30% of at least one subsidiary component selected from the group consisting of each not over than about 7% of Cr, Mo, Ge and Au, each not over than about 10% of Co and V, not over than about 15% of W, not over than about 20% of Ta, each not over than about 25% of Cu and Mn, each not over than about 5% of Al, Si, Ti, Zr, Hf, Sn, Sb, Ga, In, Tl, Zn, Cd, rare earth elements and platinum group elements, each not over than about 3% of Be, Ag, Sr and Ba, and each not over than about 1% of B and P; and a remainder being Fe as a main component with a minor amount of unavoidable impurities, and having an effective permeability of at least about 3,000 at 1 KHz, a saturation magnetic flux density of at least about 4,000 G, and a recrystallized texture of {110}<112>+{311}<112>.

* * * * *

UNITED STATES PATENT AND TRADEMARK OFFICE

CERTIFICATE OF CORRECTION

PATENT NO. : 4,710,243

DATED : December 1, 1987

INVENTOR(S) : Hakaru Masumoto, Yuetsu Murakami

It is certified that error appears in the above-identified patent and that said Letters Patent is hereby corrected as shown below:

Please change claim 1 from "1. A wear-resistant alloy having a high permeability, comprising by weight about 60-90% of Ni, about 0.5-14% of Nb, and a remainder being Fe with unavoidable impurities, and having an effective permeability of at least about 3,000 at 1 KHz, a saturation magnetic flux density of at least about 4,000 G, and a recrystallized texture of {110}<112>+ {311} <112>." to --1. A wear-resistant alloy having a high permeability, comprising by weight about 60-90% of Ni, about 0.5-14% of Nb and about 0.001-5% of Zn as main components; about 0.01-30% of at least one subsidiary component selected from the group consisting of each not over than about 7% of Cr, Mo, Ge and Au, each not over than about 10% of Co and V, not over than about 15% of W, not over than about 20% of Ta, each not over than about 25% of Cu and Mn, each not over than about 5% of Al, Si, Ti, Zr, Hf, Sn, Sb, Ga, In, Tl, Cd, rare earth elements and platinum group elements, each not over than about 3% of Be, Ag, Sr and Ba, each not over than about 1% of B and P, and not over than about 0.1% of S; and a remainder being Fe as a main component with a minor amount of unavoidable impurities, and having an effective permeability of at least about 3,000 at 1 KHz, a saturation magnetic flux density of at least about 4,000 G, and a recrystallized texture of {110}<112>+{311}<112>.--

Please change claim 2 from "2. A wear-resistant alloy having a high permeability, comprising by weight about 60-90% of Ni and about 0.5-14% of Nb as main components; about 0.01-30% of at least one subsidiary component selected from the group consisting of each not over than about 7% of Cr, Mo, Ge and Au, each not over than about 10% of Co and V, not over than about 15% of W, not over than about 20% of Ta, each not over than about 25% of Cu and Mn, each not over than about 5% of Al, Si, Ti, Zr, Hf, Sn, Sb, Ga, In, Tl, Zn, Cd, rare earth elements and platinum group elements, each not over than about 3% of Be, Ag, Sr and Ba, each not over than about 1% of B and P, and not over than 0.1% of S; and a remainder being Fe as a main component

UNITED STATES PATENT AND TRADEMARK OFFICE

CERTIFICATE OF CORRECTION

PATENT NO. : 4,710,243

DATED : December 1, 1987

INVENTOR(S) : Hakaru Masumoto, Yuetsu Murakami

It is certified that error appears in the above-identified patent and that said Letters Patent is hereby corrected as shown below:

with a minor amount of unavoidable impurities, and having an effective permeability of at least about 3,000 of 1 KHz, a saturation magnetic flux density of at least about 4,000 G, and a recrystallized texture of {110}<112>+{311}<112>." to --2. A wear-resistant alloy having a high permeability, comprising by weight about 60-90% of Ni, about 0.5-14% of Nb and about 0.001-5% of Cd as main components; about 0.01-30% of at least one subsidiary component selected from the group consisting of each not over than about 7% of Cr, Mo, Ge and Au, each not over than about 10% of Co and V, not over than about 15% of W, not over than about 20% of Ta, each not over than about 25% of Cu and Mn, each not over than about 5% of Al, Si, Ti, Zr, Hf, Sn, Sb, Ga, In, Tl, Zn, rare earth elements and platinum group elements, each not over than about 3% of Be, Ag, Sr and Ba, each not over than about 1% of B and P, and not over than about 0.1% of S; and a remainder being Fe as a main component with a minor amount of unavoidable impurities, and having an effective permeability of at least about 3,000 at 1 KHz, a saturation magnetic flux density of at least about 4,000 G, and a recrystallized texture of {110}<112>+{311}<112>.--

Signed and Sealed this

Thirtieth Day of August, 1988

*Attest:*

DONALD J. QUIGG

*Attesting Officer*

*Commissioner of Patents and Trademarks*